United States Patent [19]

Salyer

[11] Patent Number: 4,657,246

[45] Date of Patent: Apr. 14, 1987

[54] WEIGHT EXERCISE MACHINE

[76] Inventor: Alan Salyer, 1092 Louise, Apt. 23, Ypsilanti, Mich. 48197

[21] Appl. No.: 727,745

[22] Filed: Apr. 26, 1985

[51] Int. Cl.[4] ..... A63B 21/06

[52] U.S. Cl. ..... 272/117; 272/118; 272/DIG. 4

[58] Field of Search ..... 272/117, 116, 118, 134, 272/143, 128, 145, DIG. 4, 123

[56] References Cited

U.S. PATENT DOCUMENTS

| | | | |
|---|---|---|---|
| 931,699 | 8/1909 | Medart | 272/118 |
| 1,052,962 | 2/1913 | Reach | 272/118 |
| 1,547,268 | 7/1925 | Sotomayor | 272/118 |
| 2,977,120 | 3/1961 | Morris | 272/118 |
| 3,815,903 | 6/1974 | Blomquist | 272/118 |
| 4,243,219 | 1/1981 | Price | 272/117 |
| 4,257,590 | 3/1981 | Sullivan et al. | 272/117 |
| 4,512,572 | 4/1985 | Hamm | 272/145 X |
| 4,531,730 | 7/1985 | Chenera | 272/144 |

*Primary Examiner*—Richard J. Apley
*Assistant Examiner*—Robert W. Bahr
*Attorney, Agent, or Firm*—Rhodes and Boller

[57] ABSTRACT

A weight exercise machine comprising a cable and sheave system via which the user operates a stack of weights by grasping pulls. The pulls are attached to free ends of the cable whereby the cable is untethered on the machine frame. The untethered ends pass through respective sheave assemblies which are vertically adjustable on the machine frame and the cable is guided by a system of pulleys for an operative engagement with the weight stack. The weight stack is mounted on a separate rack frame which is adjustably inclinable on the machine frame. The weight stack is arranged for operation along the length of the rack frame so that as a consequence, the resistance encountered by the user when operating the machine is a function of the inclination of the rack frame. A power device such as a motor-drive ball screw and nut may be used to adjust the inclination of the rack frame. An optional feature comprises a power seat which has a foot rest containing control switches for operating the adjustment mechanism. Plural embodiments of sheave assemblies are also disclosed, and the sheave assemblies can be made power adjustable as well.

17 Claims, 11 Drawing Figures

WEIGHT EXERCISE MACHINE

BACKGROUND AND SUMMARY OF THE INVENTION

This invention relates to weight exercise machines. More particularly it relates to a weight exercise machine of the type in which a cable and sheave system is operated by the user against a load resistance such as a stack of weights.

In certain respects the present invention is an improvement upon my co-pending allowed U.S. patent application Ser. No. 464,092 filed Feb. 4, 1983.

Cable and sheave systems are used in certain weight exercising machines where the user exercises against a load resistance by pulling on a cable which is guided by sheaves. These machines can offer certain advantages over other exercise machines, and the cable exercise machine of my co-pending application offers a number of significant improvements over prior cable exercise machines.

The invention of this new application is directed to still further improvements in this general subject. Certain aspects of this invention constitute further improvements upon the machine of my co-pending allowed application and in other respects the present invention provides totally new and unique features in cable exercise machines.

The prior art which is known comprises U.S. Pat. Nos. 374,496; 1,253,885; 2,977,120; 3,438,627; 3,647,209; 4,199,139 and 4,402,504.

One advantage of using a cable exercise machine is that it allows a single track of weights to be utilized for different exercises chosen by the user. Accordingly the user can perform a variety of exercises more conveniently.

It is known in the art to construct cable exercise machines with different adjustment capabilities, not only for the purpose of performing various different exercises but also for the purpose of adapting the machine to the physical characteristics of the individual users. Thus the broad aspect of adjustment means in weight exercise machines is known.

One important feature of the present invention involves an adjustment for the load resistance whereby it is more convenient for the user to set the amount of resistance which he or she desires to use for any given exercise. The adjustment can be performed automatically without the need for the user to place additional weights onto or remove them from the weight stack, and this is a desirable attribute in promoting the maximum benefit to the individual user. In other words the user can concentrate on performing the particular exercises which he or she desires without the need to be concerned with time consuming and sometimes cumbersome adjustment of weight stacks.

Moreover the adjustment of the weight stack of the present invention is conducted within a relatively compact area. Indeed, it is possible to achieve a wide range in load resistance capabilities through the adjustment.

Briefly this aspect of the present invention comprises a rack frame whose angular inclination relative to a horizontal plane can be selectively adjusted. A weight carrier is arranged for travel lengthwise along the rack frame and the weight carrier itself can comprise the weight which is to be acted upon by the individual or additional weights can be stacked onto it. Although the rack frame itself is adjustable in inclination, once the weight rack has been adjusted to a particular inclination for exercise use, it remains in that inclination during use until such time as the user chooses to readjust it.

A cable and sheave system is operatively associated with the weight carrier, and when the user operates the cable through the system of sheaves he moves the weight carrier along the rack frame. The load resistance which the user encounters is a function of the inclination of the rack frame and the weight of the carrier and any additional weights which may be stacked upon it.

The machine is especially advantageous in that for any of the rack frame's various adjustment positions, there is no need to perform any adjustment of the cable. In other words the cable automatically tracks the adjustment of the inclined rack without any significant change in the amount of slack, if any, in the cable. Thus it is possible for the user to occupy the same use position and adjust the rack frame to various inclinations without the need to reposition himself to use the cable.

Another aspect of the present invention which is deemed to constitute an improvement upon that illustrated in my co-pending application involves the manner in which the cable is operatively related on the machine with respect to the user. The cable is trained through the sheaves of the sheave system so as to have an operative coupling with the weight carrier along an intermediate portion of the cable's length. The free ends of the cable pass through respective sheave assemblies on the machine's frame and terminate in respective pulls. Typically the pulls are manually grasped by the user for performing exercises with both arms, but it is possible for only one pull to be used at a time. Moreover, one or both of the pulls can be operated by the user through an intervening mechanism. For example in the invention disclosed in my pending application, it is possible to connect the pull to a foot plate which is operated by a seated user to perform leg exercises.

With the arrangement of the present invention wherein both ends of the cable are "live", the possibilities for usage are expanded. Moreover these possibilities can be realized with the same features inherent in my earlier invention whereby when there is to be a vertical adjustment of the sheave assemblies on the machine's frame, it has no effect on the cable as far as the user is concerned.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
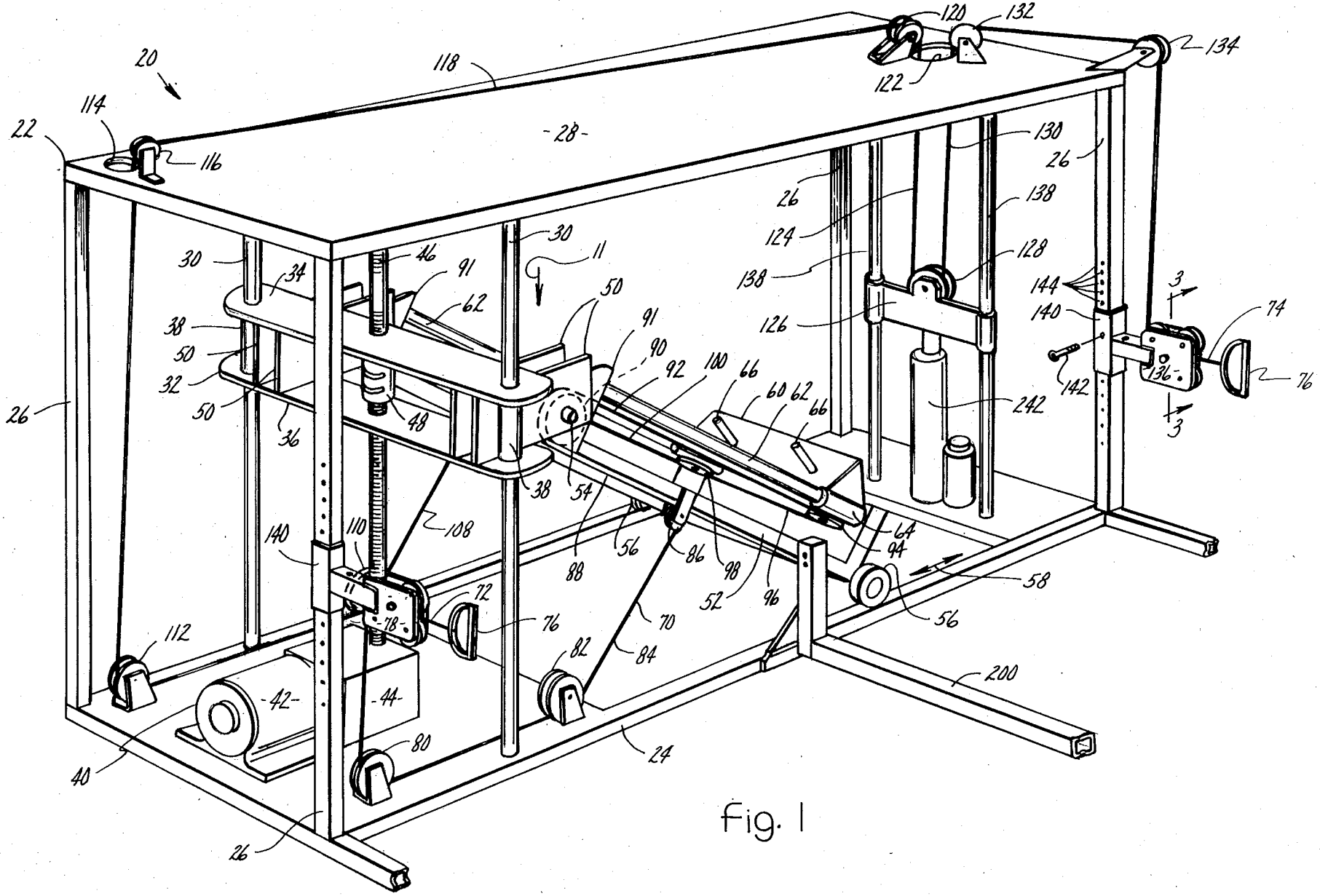
FIG. 1 is a fragmentary perspective view illustrating a principal portion of an exercise machine of the present invention.
Figure 2:
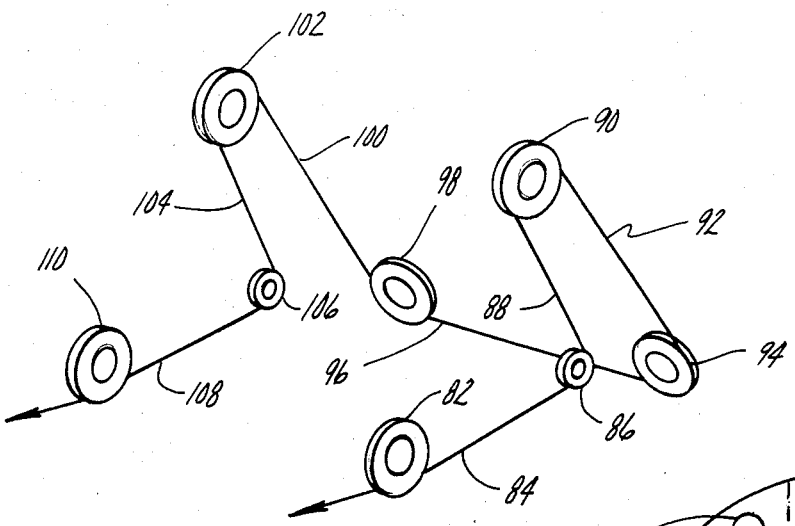
FIG. 2 is a schematic diagrammatic view useful in explaining certain aspects of the organization and arrangement of that portion of the machine which is shown in FIG. 1.

FIG. 1 illustrates the general organization and arrangement of a main portion of an exercise machine 20 embodying the principles of the present invention. Additional details useful in explaining this portion of the machine will be seen in and described with reference to FIGS. 2, 3, 4, and 11 as well.

It is to be understood that the preferred embodiment is intended to be illustrative of the principles of the present invention and that specific details may depend upon the particular manner in which the principles of the invention are embodied.

Exercise machine 20 is shown adapted for mounting on a horizontal floor. The machine has a frame designated by the general reference numeral 22 which comprises various horizontal and vertical members in the form of tubular bars of square cross section. As seen in FIG. 1 the exercise machine may be considered to have a generally rectangular appearance although this is merely illustrative of the disclosed embodiment.

This rectangular framework comprises horizontal rails arranged to form a closed perimeter rectangular base structure 24. At the four corners there uprights 26 of identical height. The top is enclosed by a rectangular cover structure 28.

A pair of vertical upright guide rods 30 are arranged parallel to each other on opposite sides of frame 22 and are supported between base structure 24 and the cover structure 28.

An adjuster 32 is guided for vertical travel along guides 30, and it essentially spans the width of frame 22 as shown. Adjuster 32 comprises flat top and bottom pieces 34, 36. Sleeves 38 are attached to, and disposed between, the two pieces 34, 36 adjacent the ends. The pieces 34 and 36 have apertures which align with sleeves 38 so that sleeves 38 guide adjuster 32 on the guides 30.

A mechanism for vertically positioning adjuster 32 is designated by the general reference numeral 40. This adjuster mechanism comprises an electric motor 42, a reducer 44, and a screw 46, such as a ball screw. Screw 46 extends vertically from reducer 44 and the upper end of the screw is suitably journaled on cover structure 28. Operation of electrical motor 42 through reducer 44 is effective to rotate screw 46. The screw is disposed midway between the lengthwise sides of the machine so as to be disposed centrally of adjuster 32. Suitable apertures are provided in both pieces 34, 36 of the adjuster, and a nut 48 is attached to the adjuster between these apertures. Nut 48 has an operative coaxial engagement with screw 46 so that as screw 46 rotates, nut 48 travels vertically up and down the ball screw to thereby vertically position adjuster 32.

From this disclosure then, one can appreciate that operation of motor 42 is effective to position adjuster 32 vertically along guides 30 to any desired vertical elevation within the vertical range of travel. This vertical range of travel extends for substantially the full exposed length of the ball screw (less the length of nut 48). In the illustrated embodiment, the adjuster cannot be lowered to the level of base structure 22, but other designs could be embodied to take advantage of the full length of travel available on guides 30 by an appropriate modification of the mechanism 40.

Two pairs of cheek plates 50 are attached to adjuster 32 on opposite sides of screw 46. Each pair of cheek plates 50 is disposed slightly inwardly of the corresponding guide 30. The two cheek plates of each pair are parallel with each other and slightly spaced apart. The cheek plates project so as to extend beyond pieces 34 and 36 to one side of the adjuster. The purpose of doing this is to provide for the cheek plates to pivotally support a ramp frame 52.

Figure 11:
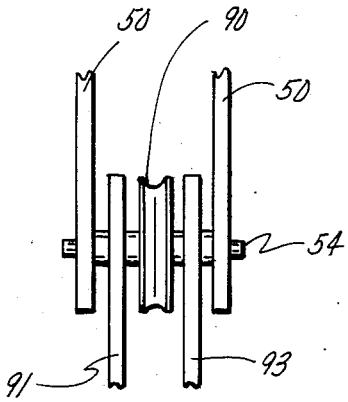
FIG. 11 is an enlarged fragmentary view looking in the direction of arrow 11 in FIG. 1.

The ramp frame may be considered somewhat like a wheeled dolly. The upper ends of the two side members of the ramp frame are pivoted on the cheek plates by means of pivot pins 54. FIG. 11 illustrates detail in the pivot attachment whereby a pivot pin 54 passes through apertures in the two cheek plates 50, and through the upper end of the ramp frame. FIG. 11 will be described in more detail later on.

Ramp frame 52 is further provided with a pair of wheels 56 at the bottom which rest on the lengthwise extending members of the base frame 22 in the manner shown, the wheels 56 engaging the ramp frame to roll along base structure 22 in the direction of the length of the machine. In other words in the directions indicated by the double arrow 58 in FIG. 1.

The pivoting of the upper end of the ramp frame on adjuster 32 in conjunction with the wheels 56 at the bottom enables the vertical travel of adjuster 32 to be effective to cause the ramp frame to roll along base structure 22 while this rolling action is accompanied by a change in the inclination of the ramp frame relative to the horizontal. For example it will be appreciated that as adjuster 32 is elevated, the inclination of ramp frame 52 relative to horizontal increases, and as the adjuster is lowerated the inclination decreases. By adjustment of adjuster 32 through use of operating mechanism 40, ramp frame 52 may be set to any desired inclination within a range of inclinations.

Ramp frame 52 further contains a weight carriage 60 which is guided for motion along the length of ramp frame 52 by means of a pair of guide rods 62 on opposite sides. The guide rods 62 are secured to the ramp frame 52 in any suitable manner and are parallel to the length of the ramp frame. Hence as the ramp frame is inclined, so are the guide rods 62. The weight carriage 60 comprises a pair of sleeves 64 via which it is guided on the guide rods 62.

A pair of pins 66 are also provided on the weight carriage for receiving a stack of one or more additional weights which may be selectively applied to the weight carriage in accordance with the exercise to be conducted.

The user of the exercise machine will perform exercises which cause the weight carriage and any stack of weights supported thereon to move back and forth along guide rods 62. Because the inclination of the ramp frame can be adjusted, the inclination of the weights can be set to the user's preference to create a resitance which is correlated with the degree of inclination. In other words with the ramp frame most steeply inclined, the effect to gravity will be greatest and therefore impose a greater resistance upon the user. With the ramp frame less steeply inclined, the influence of gravity is less insofar as the effect on the user is concerned.

The means by which the user operates the weight carriage comprises a cable and a system of sheaves which are arranged on the machine in a particular way which will not be described.

The cable is designated by the general reference numeral 70 although in the ensuing description, segments of the cable may have particular reference numeral callouts for illustrative purposes. The illustrated arrangement comprises the cable being untethered and this constitutes a further advantageous aspect of the machine. When referring to the cable as being untethered we mean that both ends of the cable are "live". These ends are designated by the reference numerals 72 and 74. Attached to each end 72, 74 is a pull 76.

The cable end 72 extends from its pull 76 through a sheave assembly which is designated by the general reference numeral 78. Details of this sheave assembly 78 will be explained later. From sheave assembly 78 the cable extends downwardly to the sheave 80 which is arranged in the manner shown on base structure 22.

The cable is guided by a further sheave 82 also on base structure 22, and from sheave 82 a cable segment 84 extends in an inclined manner to a sheave 86 which is on ramp frame 52. The disclosure shows sheave 86 to be disposed at the underside of the ramp frame just exactly half way along its length.

From sheave 86 the cable extends parallel to the length of the ramp frame's side along a segment 88 in an upward inclination to loop around a further sheave 90 which is disposed between two ramp frame cheek plates 91, 93 on pin 54. (See FIG. 11) The two ramp frame cheek plates 91, 93 fit between the cheek plates 50. Sheave 90 provides a 180 degree reversal of the cable on the ramp frame from segment 88 to a further segment 92 extending downwardly along the ramp frame side in the direction of inclination of a sheave 94 which is disposed to the underside of and on the weight carriage 60 at one side thereof.

Figure 4:
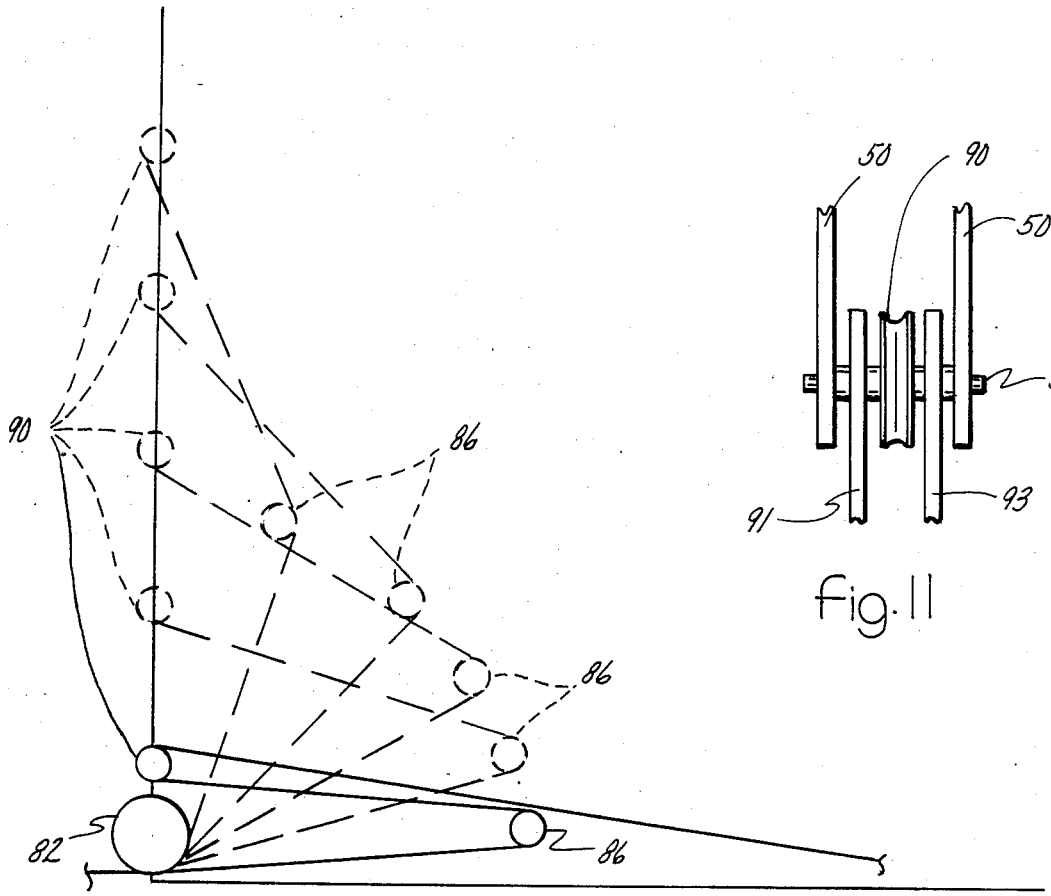
FIG. 4 is a diagram useful in illustrating principles of certain aspects of the present invention.

From there the cable extends along a segment 96 to a further sheave 98 at the other side of the weight carriage. From there the cable extends upwardly along the length of the opposite side of the ramp frame along a segment 100 to a further sheave 102 which is arranged with respect to the ramp frame and the far pair of cheek plates and pivot pin 54 as was sheave 90 at the near pair of cheek plates. Because the perspective of FIG. 1 renders it difficult to portray the full details, FIG. 4 schematically shows the cable and sheave system on the ramp frame. Sheave 102 provides essentially a 180 degree reversal of the cable travel so that on the far side of the ramp frame as viewed in FIG. 1 there is a segment 104 analogous to the segment 88 on the near side. There is also a sheave 106 on the opposite side of the ramp frame corresponding to sheave 86. From sheave 106 the cable extends along a segment 108 which corresponds to the segment 84 on the near side. The cable is then trained around a pair of sheaves 110, 112 on base 22 opposite sheaves 82 and 80.

From sheave 112 the cable extends vertically upwardly through a clearance hole 114 in the cover structure 28. There it is trained around a sheave 116 to extend along a segment 118 to a further sheave 120 which is adjacent the opposite ends of the machine but centrally located with respect to the width of the rectangular portion.

There is an aperture 122 in cover structure 28 and the cable extends through it and along a segment 124 to a take-up sheave assembly 126. Take-up assembly 126 comprises a takeup sheave 128 around which the cable is trained and the cable extends back upwardly along a segment 130 which is generally parallel to the segment 124. It passes back through aperture 122 and is trained around another sheave 132 and finally to a sheave 134 which is at the top right hand corner.

From there the cable extends downwardly to another sheave assembly 136 which is similar to the sheave assembly 78. The cable end 74 extends from this sheave assembly 136 to the corresponding pull 76.

The take-up sheave assembly 126 is selectively positionable vertically on a pair of parallel vertical guides 138 attached to the frame. Once it is in a desired adjustment to set a desired amount of slack in the cable, it is locked in place on the guides.

FIG. 1 illustrates there to be a certain amount of slack in the cable between each pull and the corresponding sheave assembly. The drawing represents the cable being taut so that operation of the pulls in a sense away from their respective sheave assemblies 78, 136 will be effective to cause the weight carriage to travel upwardly on the rack frame at the particular inclination adjustment. In other words the extension of the pulls will be effective to cause shortening in the lengths of the cable segments 92 and 100 since they are between the only points in the sheave system where there can be relative movement between sheaves. Such movement is between sheave 90 and sheave 94 on one side and between sheave 98 and sheave 102 on the opposite side.

One of the outstanding features of the invention is that the inclination of the ramp frame can be adjusted by operation of motor 42 without any significant effect on the amount of slack in the cable. This is done by a particular relationship of the sheaves 82, 86, 106 and 110. It is also graphically portrayed with reference to FIG. 4. By making the diameter of sheaves 86 and 106 essentially one-half of the diameters of sheaves 82 and 110, and by locating the sheaves 86, 106 essentially half-way along the length of the ramp frame, the adjustment in inclination of the ramp frame does not change the amount of slack in the cable segments 84, and 108. Hence if the user desires to change the resistance, all he need do is operate motor 42. There is no need to make any adjustment of the take-up 126. However if such an adjustment of take-up 126 were desired for other purposes it could be done also.

If the user desires to exercise with only one of the two pulls 76 he can operate that pull to pull the cable through the system until the opposite pull stops at the corresponding sheave assembly. Thereafter, continued operation of the one pull will lift the weights. Thus the attachment of the pulls to the cable should be designed with this possibility in mind.

It is also to be observed that the two sheave assemblies 78 and 136 are vertically positionable along their respective vertical rails 26 at the two corners. For example each sheave assembly may comprise a tubular sleeve 140 which fits onto the corresponding upright. Each sleeve has a removable pin connection 142 to the upright and a series of holes 144 are provided in each upright to provide for a different range of adjustments.

In the illustrated construction both sleeves 140 are unpinned when an adjustment is to be performed. An upward adjustment of one sleeve is accompanied by similar upward adjustment of the other in a like amount. Because the two vertical cable segments extending from the respective sheave assemblies 78 and 136 are in opposite directions, the adjustment of the two sheave assemblies on the respective uprights will simply cause the cable to move through the sheave system without any accompanying motion being imparted to the weight carriage. For example, if sheave assembly 78 is elevated, the increase in length of the vertical segment of the cable between sheave assembly 78 and sheave 80 cancels the decrease in the length of the vertical cable segment between sheave 134 and sheave assembly 136. Likewise if the sheave assembly 78 is adjusted downwardly, the decrease in length of the vertical cable segment between it and sheave 80 is accompanied by an increase in the length of the segment between sheave 134 and sheave assembly 136. Generally both sheave assemblies will be positioned at the same vertical elevation although this is not absolutely necessary, for example where the take-up 126 is also provided.

Figure 3:
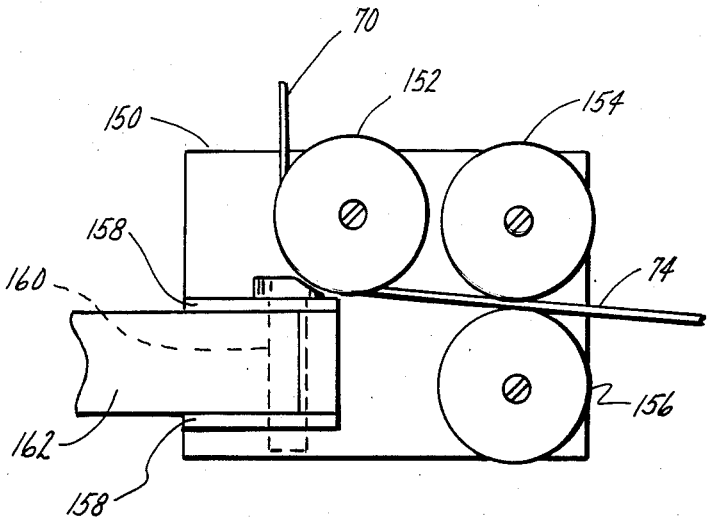
FIG. 3 is an enlarged fragmentary view looking in the direction of arrows 3—3 in FIG. 1.

FIG. 3 illustrates further detail of one of the sheave assemblies, sheave assembly 136 in particular. The sheave assembly comprises a pair of side plates 150 which support between them three sheaves 152, 154, 156. The sheaves are journaled on the side plates 150 with their axes parallel. Flanges 158 span the two side plates 150 in the manner shown and form a throat which can be fitted over and pinned at 160 to a bar 162 which projects from the adjustment sleeve 140. Suitable apertures are provided in the bar and the flanges for pin 160. With this arrangement the sheave assembly can be pivoted about the vertical axis of the pin to facilitate the conformance of the sheave assembly to the user.

In certain respects the sheave assemblies are similar to that illustrated in my co-pending allowed patent application Ser. No. 464,092. They endow the machine with the ability to vertically adjust the sheave assemblies without affecting the slack, if any, in the cable. Thus they can be adjusted vertically to any desired vertical position without the need for the user to move either further from or closer to the machine.

However this new embodiment offers a number of significant advantages.

As noted above both ends of the cable are "live". The arrangement also differs from that of my previous invention in that there are two vertically aligned sheaves 154, 156 where the cable enters from the pull, and the sheave 154 is at the same elevation as sheave 152.

The arrangement of sheave assembly 78 utilizes exactly the same construction as that shown in FIG. 3 except that it is mounted on its own bar 162 upside down from the manner of mounting sheave assembly 136. Therefore the sheave assembly 78 has the two sheaves 152, 154 below rather than above the third sheave 156. The construction also enables the pinning of the sheave assembly to the bar to be accomplished in the same manner.

Although the FIG. 1 embodiment of the invention shows there to be two separate sheave assemblies, it is possible to embody principles into a single sheave assembly by combining the two.

FIGS. 5, 6, 7 and 8 illustrate a further portion of the cable exercise machine which is intended to be utilized in conjunction with the portion already described with reference to FIGS. 1 through 4. A tubular bar forms a rail 200 which projects away from frame 22 and is supported in slightly spaced parallel relation to the floor. Rail 200 is located midway between the two vertical uprights which contain the sheave assemblies 78 and 136.

A power seat 202 containing four wheels 204 is disposed adjacent frame 22 and cooperatively related with rail 200 to be guided for selective positioning along the length of rail 200. in this way the power seat may be positioned at a desired distance from the machine portion illustrated in FIG. 1 along an axis centrally between the two sheave assemblies 78, 136.

The four wheels 204 are arranged two each on front and rear axles 206 which extend fully across the width of the power seat 202. Centrally journalled on each axle 206 is a roller 208. Each roller 208 is axially retained by means of retaining rings 210 on opposite sides and the rollers are arranged to engage rail 200 from beneath as in the manner best shown by FIG. 6.

Rollers 208 therefore serve to guide power seat 202 for travel on the floor in the direction of rail 200.

The power seat also comprises a seat cushion 212 and a seat back 214 which are generally at a right angle, as shown, to allow an occupant to be seated on the cushion in a direction facing sway from the frame 22.

Figure 8:
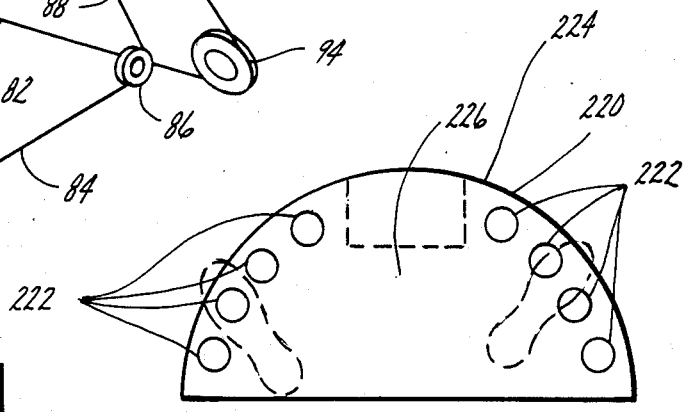
FIG. 8 is a view along arrow 8 in FIG. 5.
Figure 5:
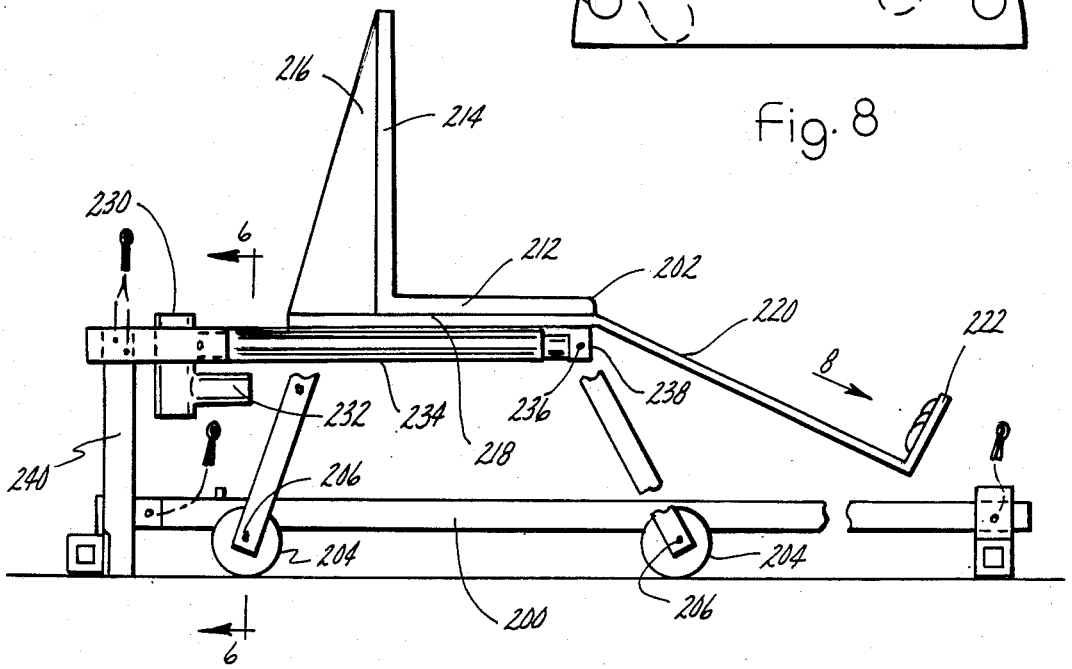
FIG. 5 is a side elevational view of a further portion of the exercise machine.

A diagonal brace 216 is used to support the seat back. The cushion 212, back 214 and diagonal brace 216 are all on a seat frame 218. The seat frame 218 includes a foot rest 220 extending forwardly of the seat cushion as shown. The foot rest is in the form of a somewhat semicircular-shaped control panel with a series of switches 222, push buttons for example, arranged adjacent the arcuate periphery 224 and adapted for selective operation by the feet of a seated occupant. As can be seen in FIG. 8, the illustrated embodiment shows a series of switches for operation by the left foot and a series for operation by the right foot. The central region 226 is left clear so that when the user is exercising, his feet can be positioned in this area. The switches may be used to perform various control functions as will be subsequently explained in more detail.

A power mechanism 230 is associated with the power seat for the purpose of adjusting the seat along the length of rail 200.

The power mechanism comprises a motor 232 which operates a ram 234. One end of the ram 234 is attached by a pin connection 236 to a bracket 238 at the forward end of the seat frame's underside. At the opposite end the mechanism is supported in a pinned manner on an upright 240.

Operation of motor 232 is effective to extend and retract the power ram causing the power seat to move forwardly and backwardly along the length of rail 200. The motor 232 may be operatively connected with the foot pedal panel 220 and operated by a seated occupant as the occupant desires. In other words the occupant pushes one push button switch to move the seat forwardly, and another to move it rearwardly. Other of the controls may perform other functions. For example one switch may serve to adjust the take-up 126 in one direction and another switch adjust it in the opposite direction, and in this regard the take-up 126 could include a power actuating device 242 as in FIG. 1.

It is possible to construct the machine such that power actuators can be used to adjust the vertical positioning of the sheave assemblies 78, 136, and these can be under the control of certain other push button switches.

Thus an occupant seated on the power seat can, at anytime, automatically adjust the machine to suit the particular exercise which he desires to perform without the necessity of leaving the seat. Therefore his efforts can be concentrated on exercising, not on adjusting the machine.

Figure 9:
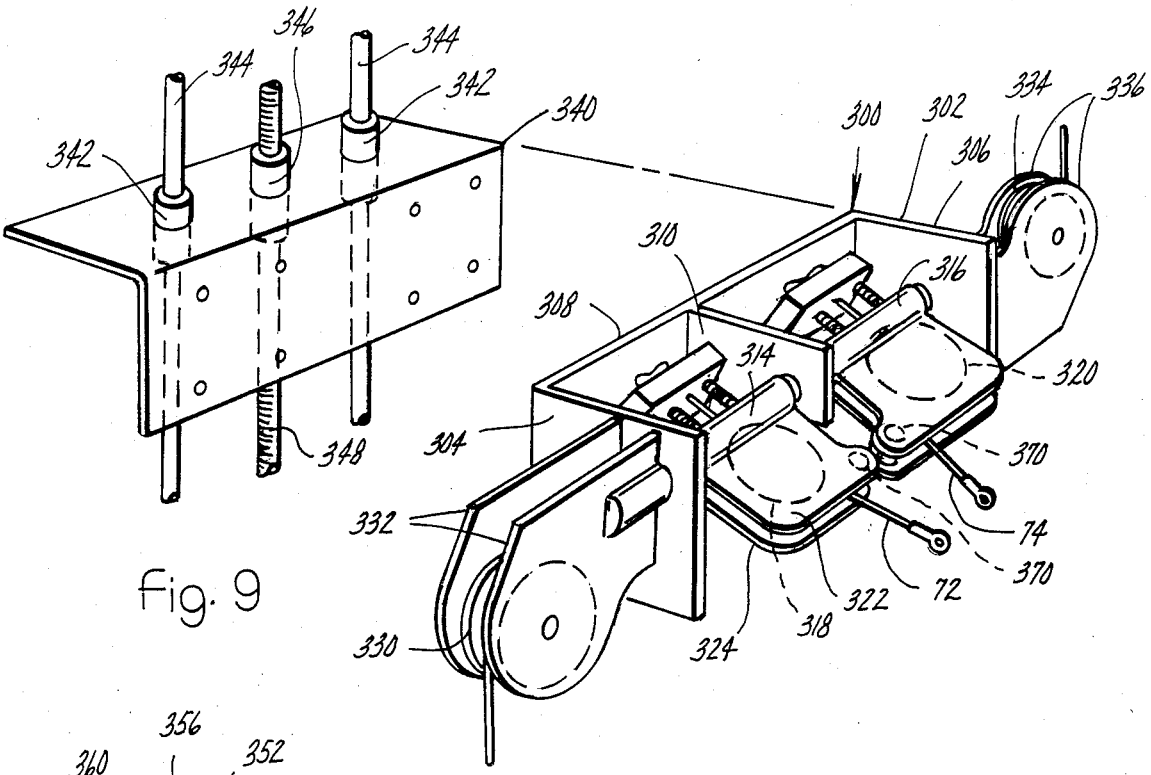
FIG. 9 is a fragmentary perspective view illustrating an alternate construction for a portion of the machine.
Figure 10:
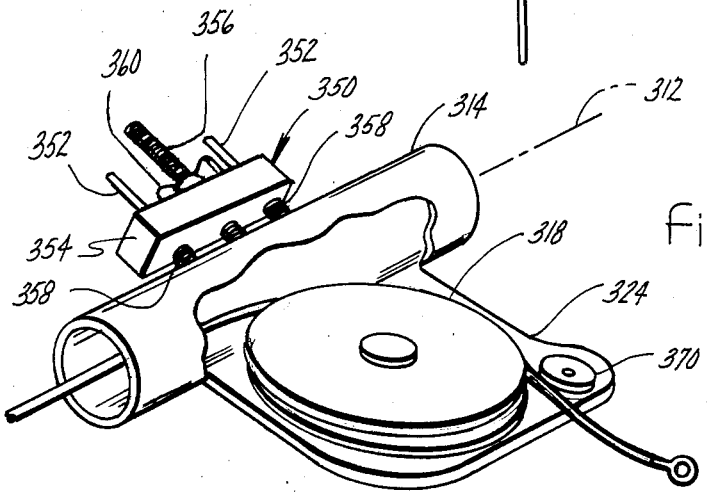
FIG. 10 is an enlarged fragmentary view of a portion of FIG. 9.
Figure 6:
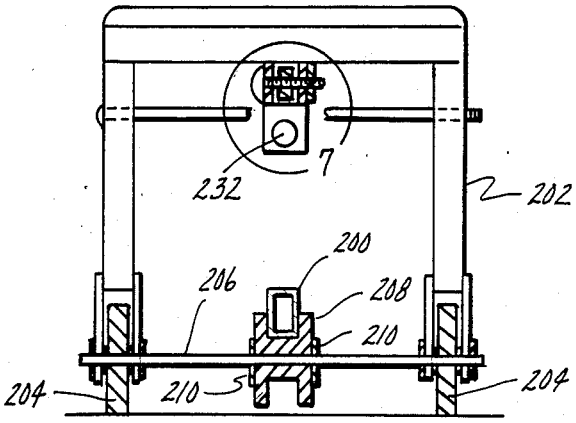
FIG. 6 is a transverse cross sectional view taken substantially in the direction of arrows 6—6 in FIG. 5.
Figure 7:
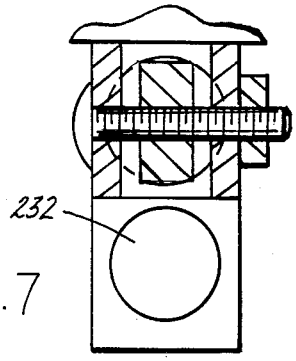
FIG. 7 is an enlarged view taken in circle 7 of FIG. 6.

FIGS. 9 and 10 illustrate an alternate form of construction for the sheave assemblies 78, 136.

This alternate form of construction relates particularly to a modified sheave assembly 300. The modified sheave assembly comprises a frame 302 which has end walls 304, 306, a side wall 308, and an intermediate wall 310 which lies half way between the end walls 304, 306. The walls 304, 310 and 306 contain aligned circular apertures lying on axis 312. With reference to FIG. 1 this axis would be horizontal and extending along the length of the frame.

A tube 314 is disposed between walls 304 and 310 and is journaled in the two apertures of these walls. Another tube 316 is disposed between walls 310 and 306 and journaled in the two apertures of these walls. Attached to one side of each tube 314 and 316 is a corresponding sheave 318, 320 respectively. Each sheave is itself disposed between a pair of parallel sheave plates 322 and 324.

The reference numerals 74 and 72 in FIG. 9 correspond to the live ends of the cable 70. As can be seen, each one of these line ends exits the sheave assembly from a corresponding sheave. The pulls are not shown in the drawing figure.

In the case of end 72 the cable is trained around sheave 318 in the manner shown in FIG. 10. The side wall of the tube 314 contains a suitable aperture for the sheave's edge, allowing the cable to pass into the tube and to centrally exit the tube through the aperture in end wall 304.

In like manner the other free end 74 is trained around sheave 320 and passes through a suitable aperture in the wall of tube 316 so as to pass through that tube and exit it at the aperture in the end wall 306.

On the outside of each end wall 304, 306 there is a further sheave. The sheave 330 is supported on end wall 304 by sheave brackets 332 and the sheave 334 is supported on end wall 306 by sheave brackets 336. Sheave 330 serves to train the cable downwardly while sheave 334 serves to train the cable upwardly. The downwardly extending segment from sheave 330 corresponds to the segment passing from sheave assembly 78 to sheave 80 in FIG. 1 while that segment of the cable from sheave 334 extending upwardly, corresponds to the segment which passes from sheave assembly 136 to sheave 134 in FIG. 1.

The mounting of the sheave assembly frame 302 to the machine is accomplished by attaching wall 308 to one leg of a right angle piece 340 as shown in FIG. 8. The attachment may be made by any suitable fastening means for example nuts and bolts passing through aligned apertures in the two. The other leg of the right angle piece is disposed horizontally. It comprises a pair of spaced apart sleeves 342 which serve to guide it on vertical rods 344 which extend between base 22 and cover 28 of the frame. A nut 346 is located centrally between the two sleeves 342 and a screw 348 has an operative engagement with the nut. Rotation of the screw is therefore effective to position the sheave assembly vertically in relation to the frame. For example, the screw could be powered and operated by the foot pedal switches described in FIG. 8.

In addition to the vertical adjustability, the two sheaves 318 and 320 are arranged to be positioned angularly about axis 312 by virtue of their tubular mounting. This facilitates the way in which the sheaves can orient themselves in relation to the user and promotes convenience for the user. The mounting of the sheaves 318 and 320 on the tubes is such as to create an imbalance unless corrected. In other words the natural tendency is for the sheaves to hang vertically.

A counterbalance effect is achieved by a mechanism 350 disposed on the diametrically opposite side of each tube from the corresponding sheave. The mechanism 350 comprises a pair of guide pins 352 projecting from the tube sidewall and onto which is slideably fitted a counterweight 354. A screw 356 also projects from each tube centrally of and parallel to the two guide pins 352. The screw passes through a clearance hole in the counterweight.

A pair of springs 358 are compressed between the wall of the tube and the counterweight. Each spring 358 is disposed around a corresponding one of the guide pins 352.

With the counterweight 354 fitted onto the screw and the guide pins, a nut 360, such as a wing nut, is threaded onto the distal end of the screw. As the nut is tightened, the counterweight is moved closer to the tube, increasingly compressing the springs in the process. By selective operation of the nut, the counterweight may be brought to a position which counterbalances the effect of the sheave and sheave plates on the opposite side. this removes the imbalance and is beneficial from the standpoint of promoting convenient use of the equipment by the user.

This sheave assembly 300 could be used in replacement of the two shown in FIG. 1 by locating it centrally of the length and re-arranging the sheaves 82, 80, 134, 132.

As an aid to maintaining the cable in contact with the sheaves 318, 320, a smaller sheave 370 is mounted between the two sheaves plates adjacent where the cable exits the sheave assembly to form the two live ends.

Although the disclosed embodiment of the present invention is a preferred one, principles of the invention may be applied to other embodiments. For example the cable could be tethered centrally to the weight carrier, and in such an embodiment the cable would extend along the middle of the rack frame and there would be one set of cheek plates 50 centrally located on the vertical adjustment. The rack frame would have a single set of cheek plates 91, 93 and single sheave 90 disposed between the cheek plates 50 and pinned by pin 54. The sheave which is located halfway along the length of the rack frame is also moved so as to be centered in the width of the rack frame and the corresponding sheave on the base of the frame is also moved to a position which is centrally located.

In other words, in such an implementation the sheaves 82, 86 and 90 could be located centrally of the rack frame. The graph plot adjustment on FIG. 4 will be applicable. It will be appreciated that there may be some need to rearrange the drive unit 40 because the pulley 80 obviously cannot be moved to the center of the frame in FIG. 1 because it would interfere with motor 42. However suitable provision may provide for the proper guidance of the cable from the relocated sheave 82 to the pull.

The motorized adjustments described above can be accomplished by conventional electrical circuits which are operated by the foot switches.

The exercise machine of the present invention has been shown to comprise significant improvements. The power seat may be considered to be an optional feature of the basic machine and if the power seat is removed the user can stand in front of the machine, grasp the pulls and perform exercises. Alternatively when the power seat is included in a machine the user can sit in it and perform exercises or alternatively the seat can be moved out of the way by disconnecting its attachment to upright 240 and disengaging it from rail 200. The resistance of the power ram may be sufficient by itself that separate locking of the seat on the rail is not required once the seat has been positioned. However if separate locking is desired this can be done by any conventional means.

It may be desirable that the range of adjustment be limited so that the rack frame cannot assume vertical, or substantially vertical, position. In the illustrated embodiment, if the ramp frame were allowed to be adjusted to a vertical, or substantially vertical, position, a subsequent attempt to adjust it toward a more horizontal inclination might result in it becoming in effect wedged by the attempted downward movement of the adjuster. In other words, because the adjuster can only move vertically the vertical force must be capable of producing an action on the rack frame which will result in the ability of its wheels to roll so that the rack frame can decline.

Although power operated adjustments are convenient, it is recognized that they entail additional expense. Accordingly while the use of power adjustment devices such as for operating the scew and for operating the takeup adjustment may be desirable, it will be appreciated that such adjustments may be manually operable instead. For example it would still be possible to utilize the screw and nut arrangement for operating the adjuster but the screw would be operated by a hand crank instead.

It will also be appreciated that although the illustrated embodiment utilizes the takeup adjuster, principles of the invention can be practiced without use of such an adjuster. Indeed one of the outstanding attributes of the invention is that the amount of slack in the cable is substantially unaffected by the adjusted position of the ramp frame by virtue of the illustrated cable and sheave system.

While a preferred embodiment of the invention has been disclosed, it will be appreciated that principles are applicable to other embodiments.

What is claimed is:

1. In a cable exercise machine having frame means, a system of sheaves on said frame means, cable means trained by said system of sheaves, load resistance means operatively coupled with said cable means, sheave assembly means adjustably positionable on said frame means providing guidance of said cable means from said system of sheaves to a user, said cable means having an operative coupling with said load resistance means by at least one sheave, said cable means terminating in two untethered ends for cooperative association with the user via which the user can exercise against said load resistance means by operating said cable means, the improvement which comprises said sheave assembly means having an operative engagement with said cable means between said system of sheaves and said untethered ends of said cable means, said sheave assembly means comprising sheaves for training said cable means adjacent its untethered ends, said sheave assembly means being adjustably positionable on said frame means without affecting the amount of slack in said cable means, said sheave assembly means comprising two sheave assemblies spaced apart from each other on said frame means, each sheave assembly training said cable means adjacent a corresponding one of its untethered ends, said two sheave assemblies being each individually positionable on said frame means to respective desired positions of adjustment, and that portion of said cable means which is trained by one of the sheave assemblies passing from that one sheave assembly to said system of sheaves in a particular direction and the portion of said cable means is trained by the other sheave assembly passing from said other sheave assembly to said system of sheaves in a direction which is opposite the direction that the first-mentioned portion of said cable means passes from said one sheave assembly to said system of sheaves, in which said two sheave assemblies are vertically positionable on said frame means and in which that portion of said cable means which is trained by said one sheave assembly passes from that one sheave assembly to said system of sheaves in a downwardly direction and the portion of said cable means which is trained by the other sheave assembly passes from said other sheave assembly to said system of sheaves in an upward direction.

2. In a cable exercise machine having frame means, a system of sheaves on said frame means, cable means trained by said system of sheaves, load resistance means operatively coupled with said cable means, sheave assembly means adjustably positionable on said frame means providing guidance of said cable means from said system of sheaves to a user, said cable means having an operative coupling with said load resistance means by at least one sheave, said cable means terminating in two untethered ends for cooperative association with the user via which the user can exercise against said load resistance means by operating said cable means, the improvement which comprises said sheave assembly means having an operative engagement with said cable means between said system of sheaves and said untethered ends of said cable means, and in which said loan resistance means comprises weight which is bodily displaceable along a path of travel when the user operates the exercise machine and including means for adjusting the inclination of that path of travel relative to a horizontal plane, said weight is guided for longitudinal motion along a weight frame and said weight frame is selectively inclinable relative to said frame means to set the inclination of said path of travel, said weight frame has an operative connection with said frame means via an adjusting mechanism for adjusting the inclination of said weight frame, the operative connection of the weight frame with said frame means comprises an adjuster which is vertically positionable of said frame means, and said weight frame is pivotally connected to said adjuster for pivotal motion about a horizontal axis on the adjuster, and means for supporting said weight frame on a surface which is below its pivotal connection to said adjuster, said weight frame comprises wheel means via which it is supported on said surface and wherein said surface is horizontally disposed whereby vertical positioning of said adjuster causes the weight frame to roll along said surface while concurrently pivoting about said horizontal axis, and said adjusting mechanism comprises an adjusting screw operated by a prime mover and a nut on said adjuster which is operated by said adjusting scew, the operation of said prime mover being effective to rotate the screw and cause the nut to travel along the screw and thereby vertically position the adjuster.

3. In a cable exercise machine having frame means, a system of sheaves on said frame means, cable means trained by said system of sheaves, load resistance means operatively coupled with said cable means, sheave assembly means adjustably positionable on said frame means providing guidance of said cable means from said system of sheaves to a user, said cable means having an operative coupling with said load resistance means by at least one sheave, said cable means terminating in two untethered ends for cooperative association with the user via which the user can exercise against said load resistance means by operating said cable means, the improvement which comprises said sheave assembly means having an operative engagement with said cable means between said system of sheaves and said untethered ends of said cable means, and in which said load resistance means comprises weight which is bodily displaceable along a path of travel when the user operates the exercise machine and including means for adjusting the inclination of that path of travel relative to a horizontal plane, said weight is guided for longitudinal motion along a weight frame and said weight frame is selectively inclinable relative to said frame means to set the inclination of said path of travel, said weight frame has an operative connection with said frame means via an adjusting mechanism for adjusting the inclination of said weight frame, the operative connection of the weight frame with said frame means comprises an adjuster which is vertically positionable of said frame means, and said weight frame is pivotally connected to said adjuster for pivotal motion about a horizontal axis on the adjuster, and means for supporting said weight frame on a surface which is below its pivotal connection to said adjuster, and said weight frame comprises a first pair of sheaves coaxial with said horizontal axis and a second pair of sheaves disposed substantially half way between said horizontal axis and said supporting means along the length of said frame weight, said system of sheaves comprising a pair of sheaves on said frame means directly below said first pair of sheaves, said cable means having portions extending from said last-mentioned pair of sheaves to train around said second pair of sheaves and to extend from said second pair of sheaves to train around said first pair of sheaves.

4. The improvement set forth in claim 3 in which said second pair of sheaves have diameters which are essentially one half the diameters of said pair of sheaves on said frame means directly below said first pair of sheaves.

5. In a cable exercise machine having frame means, a system of sheaves on said frame means, cable means trained by said system of sheaves, and weight means operatively coupled with said cable means, and in which a user exercises against said weight means by operating said cable means, the improvement which comprises means for guiding said weight means for bodily displacement along a path of travel in response to user operation of said cable means, and means for adjusting the inclination of that path of travel relative to a horizontal plane, in which said weight means is guided for longitudinal motion on a weight frame, said weight frame is selectively inclinable relative to a horizontal plane to set the inclination of said path of travel, said weight frame has an operative connection with said frame means via an adjusting mechanism for adjusting the inclination of the weight frame, and in which the operative connection of said weight frame with said frame means comprises an adjuster which is vertically positionable of said frame means, said weight frame being pivotally connected to said adjuster for pivotal motion about a horizontal axis on the adjuster, and means for supporting said weight frame on a surface which is below its pivotal connection to said adjuster, and in which said weight frame comprises a first sheave coaxial with said horizontal axis and a second sheave disposed substantially halfway along the length of said weight frame, said system of sheaves comprising a sheave on said frame means directly below said first sheave of said weight frame, said cable means having a portion extending from said sheave on said frame means which is directly below said first sheave on the weight frame to train around said second sheave on the weight frame and to extend from said second sheave on the weight frame to train around said first sheave on the weight frame and extend into operative coupling with said weight means, said second sheave on the weight frame and said sheave on said frame means which is directly below said first sheave on the weight frame being arranged so that they remain substantialy the same distance apart as the weight frame is adjusted whereby adjustment of the inclination of the weight frame imposes no significant change in the amount of slack which may exist on said cable means.

6. The improvement set forth in claim 5 in which the diameter of said second sheave on said weight frame is essentially one-half the diameter of said sheave on said frame means which is disposed directly below said first sheave of the weight frame.

7. In a cable exercise machine having frame means, a system of sheaves on said frame means, cable means trained by said system of sheaves, and weight means operatively coupled with said cable means, and in which a user exercises against said weight means by operating said cable means, the improvement which comprises means for guiding said weight means for bodily displacement along a path of travel in response to user operation of said cable means, and means for adjusting the inclination of that path of travel relative to a horizontal plane, in which said weight means is guided on a weight frame which is selectively inclinable relative to a horizontal plane to set the inclination of said path of travel, said system of sheaves comprising a pair of sheaves coaxial with said horizontal axis and a second pair of sheaves disposed on the weight frame substantially halfway along the length of the weight frame between said horizontal axis and a support surface for the weight frame, a third pair of sheaves disposed directly below said first pair of sheaves, said cable means having portions extending from said third pair of sheaves to train around said second pair of sheaves and extend from said second pair of sheaves to said first pair of sheaves, and train around said first pair of sheaves and extend to said weight means.

8. The improvement set forth in claim 7 in which the operative connection of said cable means with said weight means is via a sheave.

9. The improvement set forth in claim 7 in which said three pairs of sheaves are so constructed and arranged that the adjustment of the inclination of the weight frame has no significant effect on the amount of slack in said cable means.

10. In a cable exercise machine having frame means, a system of sheaves on said frame means, cable means trained by said system of sheaves, and weight means operatively coupled with said cable means, and in which a user exercises against said weight means by operating said cable means, the improvement which comprises a weight frame for guiding said weight means for bodily displacement along a path of travel in response to user operation of said cable means, and adjustment means for adjusting the inclination of that path of travel relative to a horizontal plane by adjusting the inclination of said weight frame to said frame means, and said weight frame has an operative connection with said frame means via an adjusting mechanism for adjusting the inclination of said weight frame on said frame means, said adjusting mechanism comprising an adjuster which is vertically positionable and a screw arranged parallel to the direction of adjustment of the adjuster, said adjuster comprising a nut having an operative engagement with the screw, guide means for guiding the adjuster on said frame means, and means for rotating the screw to cause the adjuster to move along the guide means and thereby cause the inclination of the weight frame to be adjusted.

11. The improvement set forth in claim 10 in which the screw is powered by a motor operating through a reducer.

12. In a cable exercise machine having frame means, a system of sheaves on said frame means, cable means trained by said system of sheaves, load resistance means operatively coupled with said cable means, sheave assembly means adjustably positionable on said frame means providing guidance of said cable means from said system of sheaves to a user and wherein a user exercises by operating on said load resistance means via said cable means, and said sheave assembly means being adjustably positionable along opposite directions of adjustment on said frame means, the improvement in said sheave assembly means which comprises said sheave assembly means comprising two sheave assemblies, each sheave assembly having three sheaves, one sheave assembly being associated with one portion of said cable means extending from said sheave assembly means to the user and the other sheave assembly being associated with another portion of said cable means which extends from said sheave assembly means to the user, one of said sheaves of each of said sheave assemblies providing approximately a 90° transition in the direction of said cable means as it passes through the corresponding sheave assembly and the remaining two sheaves of each sheave assembly guiding said cable means where it extends from said sheave assembly means to the user.

13. In a cable exercise machine having frame means, a system of sheaves on said frame means, cable means trained by said system of sheaves, load resistance means operatively coupled with said cable means, sheave assembly means on said frame means providing guidance of said cable means from said system of sheaves to a user and wherein a user exercises by operating on said load resistance means via said cable means, an improved sheave assembly means comprising a first sheave having its axis generally horizontally disposed for providing a transition of said cable means from vertical to horizontal as it enters the sheave assembly means, a tube journaled on the sheave assembly means with its axis horizontal and in alignment with the portion of said cable means which extends horizontally from the first sheave, the portion of said cable means which extends horizontally from the first sheave passing through said tube, an aperture in the sidewall of the tube, a second sheave mounted on the tube sidewall at the aperture with said cable means passing through the aperture in the tube sidewall and being trained by said second sheave for exiting the sheave assembly means to the user.

14. The improvement set forth in claim 13 including a third sheave mounted on said tube in cooperative association with the second sheave to assist in guiding the exiting of said cable means from the sheave assembly means.

15. The improvement set forth in claim 13 including counterweight means disposed on the tube opposite the mounting of said second sheave to provide a counterweight so that the mounting of the second sheave on the tube is counterbalanced.

16. The improvement set forth in claim 15 including adjustment means for adjusting the counterweight to achieve a state of counterbalance.

17. The improvement set forth in claim 13 in which said sheave assembly means includes a third sheave corresponding to said first sheave, a second tube corresponding to the first-mentioned tube and having an aperture in its sidewall, and a fourth sheave corresponding to said second sheave, said fourth sheave being mounted on said second tube, and a portion of said cable means training around said third sheave, passing through said second tube, through the aperture of said second tube and being trained by said fourth sheave to exit the sheave assembly means, said two tubes being independently rotatable on the sheave assembly means and having their axes coaxially arranged.

* * * * *